US007806283B2

(12) United States Patent
Metcalf

(10) Patent No.: US 7,806,283 B2
(45) **Date of Patent: *Oct. 5, 2010**

(54) ADJUSTABLE SHELVING SYSTEM

(75) Inventor: Derek Metcalf, Burr Ridge, IL (US)

(73) Assignee: Display Source Alliance, LLC, Balch Springs, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/496,931

(22) Filed: Jul. 2, 2009

(65) Prior Publication Data

US 2009/0266780 A1 Oct. 29, 2009

Related U.S. Application Data

(60) Continuation of application No. 11/700,754, filed on Jan. 31, 2007, now Pat. No. 7,571,822, which is a division of application No. 10/643,352, filed on Aug. 19, 2003, now Pat. No. 7,182,210.

(51) Int. Cl.
*A47F 5/00* (2006.01)

(52) U.S. Cl. ..... 211/175; 211/119; 211/90.03

(58) Field of Classification Search ..... 211/196, 211/106.01, 175, 119, 90.03, 106, 90.01, 211/134, 90.02, 88.02, 181.1, 119.003; 108/83, 108/90, 108, 185, 137
See application file for complete search history.

(56) References Cited

U.S. PATENT DOCUMENTS 573,835 A * 12/1896 Taylor ..... 211/119
1,428,730 A * 9/1922 Weston ..... 108/1
1,829,009 A * 10/1931 Madsen ..... 248/243
2,648,442 A * 8/1953 Lowmaster ..... 108/1
3,174,627 A * 3/1965 Marschak ..... 248/220.41
3,182,945 A * 5/1965 Sedo ..... 248/242
3,248,079 A * 4/1966 Kennedy ..... 248/242
3,280,989 A * 10/1966 Melvin et al. ..... 211/133.2
3,501,020 A * 3/1970 Krikorian ..... 211/184
3,572,626 A * 3/1971 Bertschi ..... 248/242
3,701,325 A * 10/1972 Fenwick ..... 108/1
3,760,744 A * 9/1973 Cruckshank ..... 108/64
3,795,379 A * 3/1974 Gray ..... 248/242

(Continued)

FOREIGN PATENT DOCUMENTS

EP 0442398 8/1991

(Continued)

OTHER PUBLICATIONS

U.S. Appl. No. 11/700,754, filed Jan. 21, 2007.

(Continued)

*Primary Examiner*—Jennifer E. Novosad
(74) *Attorney, Agent, or Firm*—Kilpatrick Stockton LLP

(57) ABSTRACT

An adjustable shelving assembly and a support structure for supporting the adjustable shelf assembly. The adjustable shelf assembly may include at least one extension shelf unit, slidably oriented with respect to a central shelf unit such that the width and/or depth of the shelf may be adjusted. The adjustable shelf assembly may be adjusted without removing the shelf from the accompanying support structure or causing the central shelf unit to be moved. The adjustable shelf assembly may also include structure for receiving advertisements, product identifiers or the like.

6 Claims, 13 Drawing Sheets

U.S. PATENT DOCUMENTS

| | | | | | |
|---|---|---|---|---|---|
| 3,915,097 | A * | 10/1975 | Young, Jr. | 108/6 |
| 3,993,002 | A * | 11/1976 | Stroh | 108/108 |
| 4,065,088 | A * | 12/1977 | Shell | 248/242 |
| 4,155,312 | A * | 5/1979 | Thorkildson | 108/137 |
| 4,248,352 | A * | 2/1981 | White | 211/88.01 |
| 4,250,815 | A * | 2/1981 | Swanson | 108/108 |
| 4,267,931 | A * | 5/1981 | Belotta | 211/153 |
| 4,307,671 | A * | 12/1981 | Albano | 108/6 |
| 4,378,925 | A * | 4/1983 | Griffin | 248/242 |
| 4,492,169 | A * | 1/1985 | Ware et al. | 108/6 |
| 4,500,146 | A * | 2/1985 | Peterson | 312/257.1 |
| 4,553,523 | A * | 11/1985 | Stohrer, Jr. | 126/9 B |
| 4,583,648 | A * | 4/1986 | Buffington et al. | 211/90.03 |
| 4,730,738 | A * | 3/1988 | Bartus et al. | 211/90.02 |
| 5,133,463 | A * | 7/1992 | Merl | 211/190 |
| 5,199,579 | A * | 4/1993 | Van Duyne | 211/90.04 |
| 5,205,421 | A * | 4/1993 | Bustos | 211/59.2 |
| 5,449,076 | A * | 9/1995 | Van Noord | 211/59.3 |
| 5,450,971 | A * | 9/1995 | Boron et al. | 211/134 |
| 5,460,345 | A * | 10/1995 | Trevaskis | 248/225.21 |
| 5,547,088 | A * | 8/1996 | Belokin et al. | 211/87.01 |
| 5,641,083 | A * | 6/1997 | Metcalf | 211/187 |
| 5,645,182 | A * | 7/1997 | Miller et al. | 211/134 |
| 5,769,247 | A * | 6/1998 | Merl | 211/103 |
| 5,816,419 | A * | 10/1998 | Lamson | 211/150 |
| 6,021,908 | A * | 2/2000 | Mathews | 211/90.02 |
| 6,070,841 | A * | 6/2000 | Robinson | 248/220.43 |
| 6,109,462 | A * | 8/2000 | Emalfarb et al. | 211/119 |
| 6,142,321 | A * | 11/2000 | West | 211/153 |
| 6,189,527 | B1 * | 2/2001 | Walsh et al. | 126/25 R |
| 6,332,548 | B1 * | 12/2001 | West et al. | 211/175 |
| 6,341,704 | B1 * | 1/2002 | Michel, Jr. | 211/181.1 |
| 6,357,609 | B1 * | 3/2002 | Van Noord et al. | 211/90.02 |
| 6,641,098 | B1 * | 11/2003 | Proffitt | 248/243 |
| 6,666,344 | B1 * | 12/2003 | Schneider | 211/90.02 |
| 6,726,035 | B2 * | 4/2004 | Zadak | 211/90.03 |
| 7,128,221 | B2 * | 10/2006 | Metcalf | 211/59.2 |
| 7,182,210 | B2 * | 2/2007 | Metcalf | 211/175 |
| 7,246,711 | B1 * | 7/2007 | Metcalf | 211/175 |
| 7,571,822 | B2 * | 8/2009 | Metcalf | 211/175 |
| 2002/0027115 | A1 * | 3/2002 | Gay et al. | 211/187 |
| 2005/0039641 | A1 | 2/2005 | Metcalf | |
| 2005/0092701 | A1 * | 5/2005 | Metcalf | 211/59.2 |
| 2007/0138116 | A1 | 6/2007 | Metcalf | |

FOREIGN PATENT DOCUMENTS

| | | |
|---|---|---|
| FR | 2548529 | 1/1985 |
| WO | WO9902500 | 3/1990 |
| WO | WO2005041726 | 5/2005 |

OTHER PUBLICATIONS

Office Action dated May 2, 2008 in related U.S. Appl. No. 11/700,754.
Response dated Aug. 4, 2008 in related U.S. Appl. No. 11/700,754.
Office Action dated Sep. 30, 2008 in related U.S. Appl. No. 11/700,754.
Response dated Dec. 1, 2008 in related U.S. Appl. No. 11/700,754.
Advisory Action dated Feb. 2, 2009 in related U.S. Appl. No. 11/700,754.
Notice of Allowance dated Apr. 22, 2009 in related U.S. Appl. No. 11/700,754.
U.S. Appl. No. 10/643,352, filed Aug. 19, 2003.
Office Action dated Jul. 17, 2005 in related U.S. Appl. No. 10/643,352.
Response dated Oct. 7, 2005 in related U.S. Appl. No. 10/643,352.
Office Action dated Dec. 22, 2005 in related U.S. Appl. No. 10/643,352.
Response dated May 11, 2006 in related U.S. Appl. No. 10/643,352.
Office Action dated Jul. 3, 2006 in related U.S. Appl. No. 10/643,352.
Response dated Oct. 3, 2006 in related U.S. Appl. No. 10/643,352.
Notice of Allowance dated Oct. 18, 2006 in related U.S. Appl. No. 10/643,352.

* cited by examiner

ADJUSTABLE SHELVING SYSTEM

CROSS REFERENCE TO RELATED APPLICATION

This application is a continuation of U.S. patent application Ser. No. 11/700,754 filed on Jan. 31, 2007, now allowed, which is a divisional of U.S. patent application Ser. No. 10/643,352 filed on Aug. 19, 2003, now U.S. Pat. No. 7,182,210, the entire contents of both of which are incorporated by reference herein.

BACKGROUND

The floor plans of convenience stores and other retail establishments may vary widely from location to location. Consequently, the space available for a particular product display will also vary widely. In such circumstances, it may be desirable to provide a product display or other type of shelving system that can be adapted quickly, easily, and/or inexpensively to fit the available space. Shelving systems including shelves with adjustable widths and/or depths may be used as product displays that are quickly, easily, and/or inexpensively tailored to fit the unique location where they will be used.

Adjustable shelving systems may also be useful when it becomes necessary to rearrange shelving in a particular location in response to changing needs, desires, or available space. For instance, convenience store operators may wish to rearrange product displays from time to time. Such rearrangement may be needed or desired in response to changing inventory, the installation of new equipment, rollout of a new product, or other changes affecting the amount of space available for a particular display. By using an adjustable shelving system, store operators may simply adjust the width and/or depth of the adjustable shelves to maximize the shelving area available for displaying product while avoiding the extra time and expense required to reconfigure a non-adjustable system or purchase or obtain a new product display.

Previous adjustable shelves, such as the ones disclosed in U.S. Pat. Nos. 6,332,548and 6,142,321both to West and both entitled 'Adjustable Shelving Apparatus,' may be formed from two halves, slidably joined together by a number of interlocking channel and groove structures. The channel and groove structures permit the shelf halves to slide relative to one another such that the widths of the shelves may be increased or decreased as desired. These previous shelf structures are limited, however, because the shelf structures cannot be adjusted without also modifying or reconfiguring accompanying structure supporting the shelf structures. Because both halves of the shelves move during adjustment, adjustment of the shelves may not be accomplished without disconnecting the shelves from the accompanying support structure or modifying the shelf or the support structure. Moreover, because both halves of the shelves slide relative to each other, adjustment of the shelves may not be done without disturbing product displayed on the shelf. Also problematically, previous adjustable shelves do not provide structures for the placement of advertisements, pricing information, product identifiers or other information on the shelf that does not have to be removed or repositioned during or after adjustment of the shelf width.

SUMMARY

Various embodiments of the present invention include an adjustable shelving system including at least one adjustable shelf that includes a non-moving central portion such that the shelf may be adjusted without removing the shelf from accompanying support structure or modifying the shelf or the support structure. In some embodiments, adjustment of the shelf may be accomplished without disturbing product or other items located on some portions of the shelf. Additionally, in some embodiments, the shelf may include structures for the placement of advertisements, pricing information, product identifiers or other information on the shelf that do not have to be removed or modified during or after adjustment of the shelf width and/or depth.

In various embodiments of the present invention, the shelf's dimensions may be adjusted by sliding one or more extension shelf units with respect to a central shelf unit. The extension shelf units may be slidably connected to the central shelf unit such that the dimensions of the shelf may be adjusted by sliding the extension shelf units into or out of the central shelf unit. The central shelf unit may be secured to a support structure, such as a wire stand. Consequently, only the extension shelf units, not the central shelf unit, move relative to the support structure during adjustment. Because the central shelf unit does not move relative to the support structure, adjustment of the shelf dimensions does not require removing the shelf from the support structure. Additionally, because the central shelf unit does not move relative to the support structure during adjustment, product located on the central shelf unit, as well as any product identifiers, advertisements or other material located on the central shelf unit, may be undisturbed during shelf adjustment.

DETAILED DESCRIPTION

Figure 1:
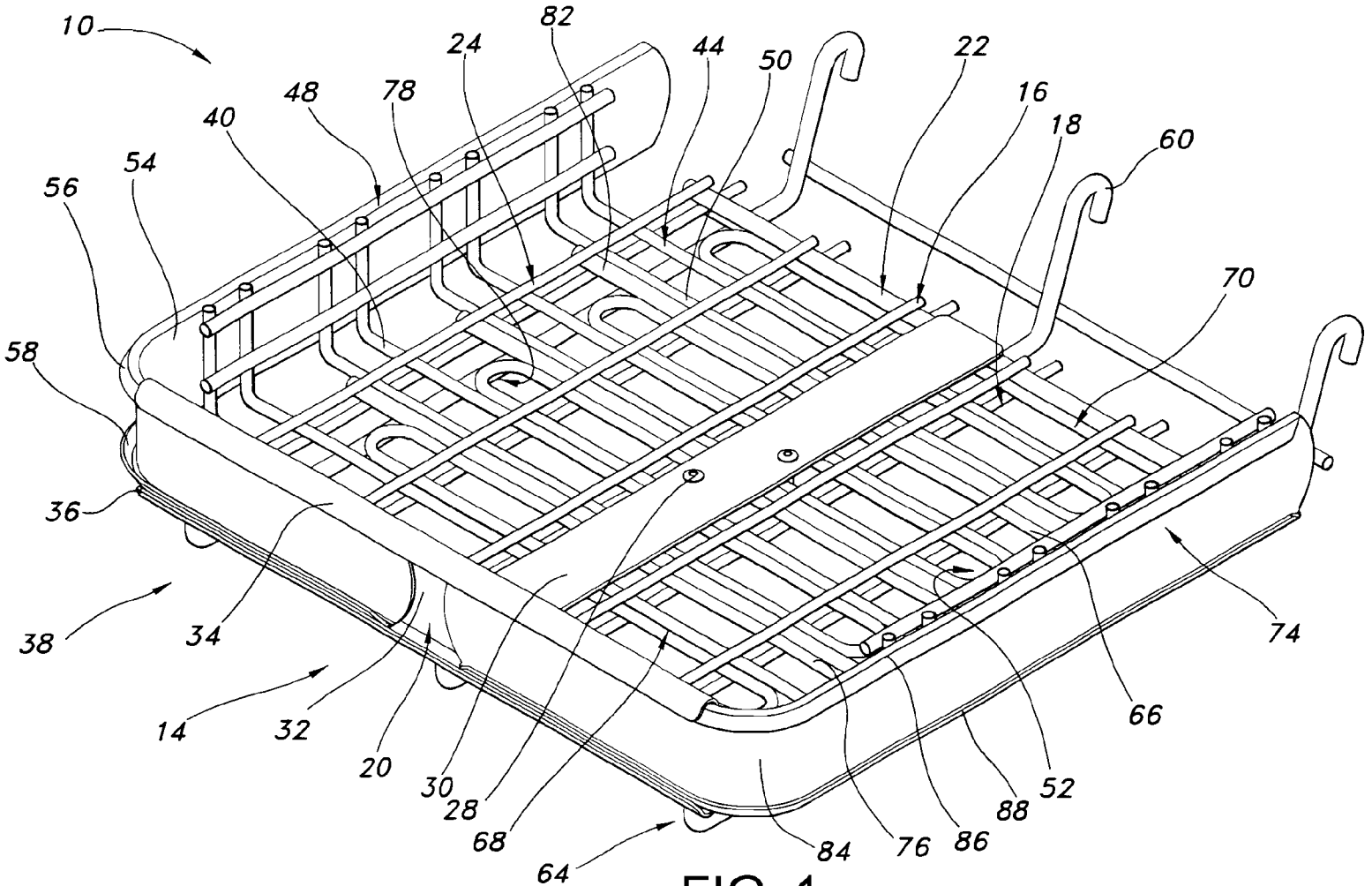
FIG. 1 shows an adjustable shelf assembly in a retracted orientation according to certain embodiments of the present invention in perspective view.

FIG. 1 shows an adjustable shelf assembly 10 according to certain embodiments of the present invention. The adjustable shelf assembly 10 includes a first extension shelf unit 38 and a second extension shelf unit 64. However, according to other embodiments of the invention, an adjustable shelf assembly may include only one extension shelf unit or multiple extension shelf units. As shown in FIG. 1, first and second extension shelf units 38 and 64 are slidably secured to a central shelf unit 14. The central shelf unit 14 has a top surface 16, a bottom surface 18, a front edge 20, a rear edge 22, a first side edge 24 (shown in FIG. 2) and a second side edge 26. Top surface 16 and bottom surface 18 may be formed from any desired material. As shown in FIG. 1, the top and bottom surfaces of central shelf unit 16 and 18 in connection with rails 82 form a wire grid. As shown in FIG. 1, portions of the first and second extension shelf units 38 and 64 are located between the top and bottom surfaces of central shelf unit 16 and 18. In some embodiments, the central shelf unit does not have a bottom surface. In those embodiments, portions of the one or more extension shelf units are preferably located underneath the top surface of the central shelf unit.

Figure 2:
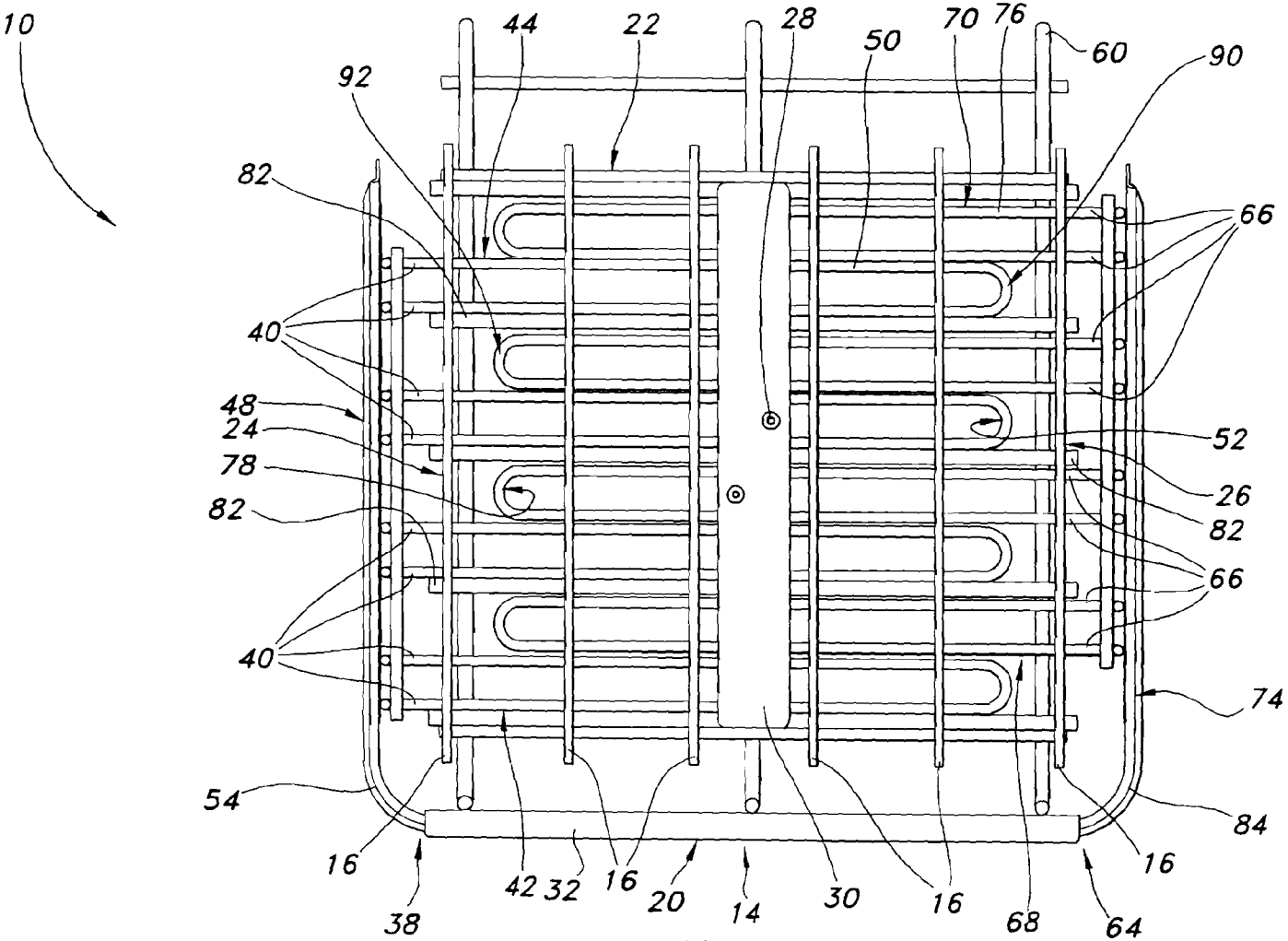
FIG. 2 shows a top view of the adjustable shelf assembly of FIG. 1.

As shown in FIG. 2, first extension shelf unit 38 has a support surface 40, a front edge 42 (shown in FIG. 7), a rear edge 44, a distal side 48 and a proximate side 90. The distal side of the first extension shelf unit 48 is located distal to the central shelf unit 14 relative to the proximate side 90. Support surface 40 may be formed from any desired material. In the embodiment shown in FIG. 2, support surface 40 is formed from bent wire.

As shown in FIG. 2, second extension shelf unit 64 has a support surface 66, a front edge 68 (shown in FIG. 7), a rear edge 70, a distal side 74 and a proximate side 92. The distal side of the second extension shelf unit 74 is located distal to the central shelf unit 14 relative to the proximate side 92. Support surface 66 may be formed from any desired material. In the embodiment shown in FIG. 2, support surface 66 is formed from bent wire.

Figure 7:
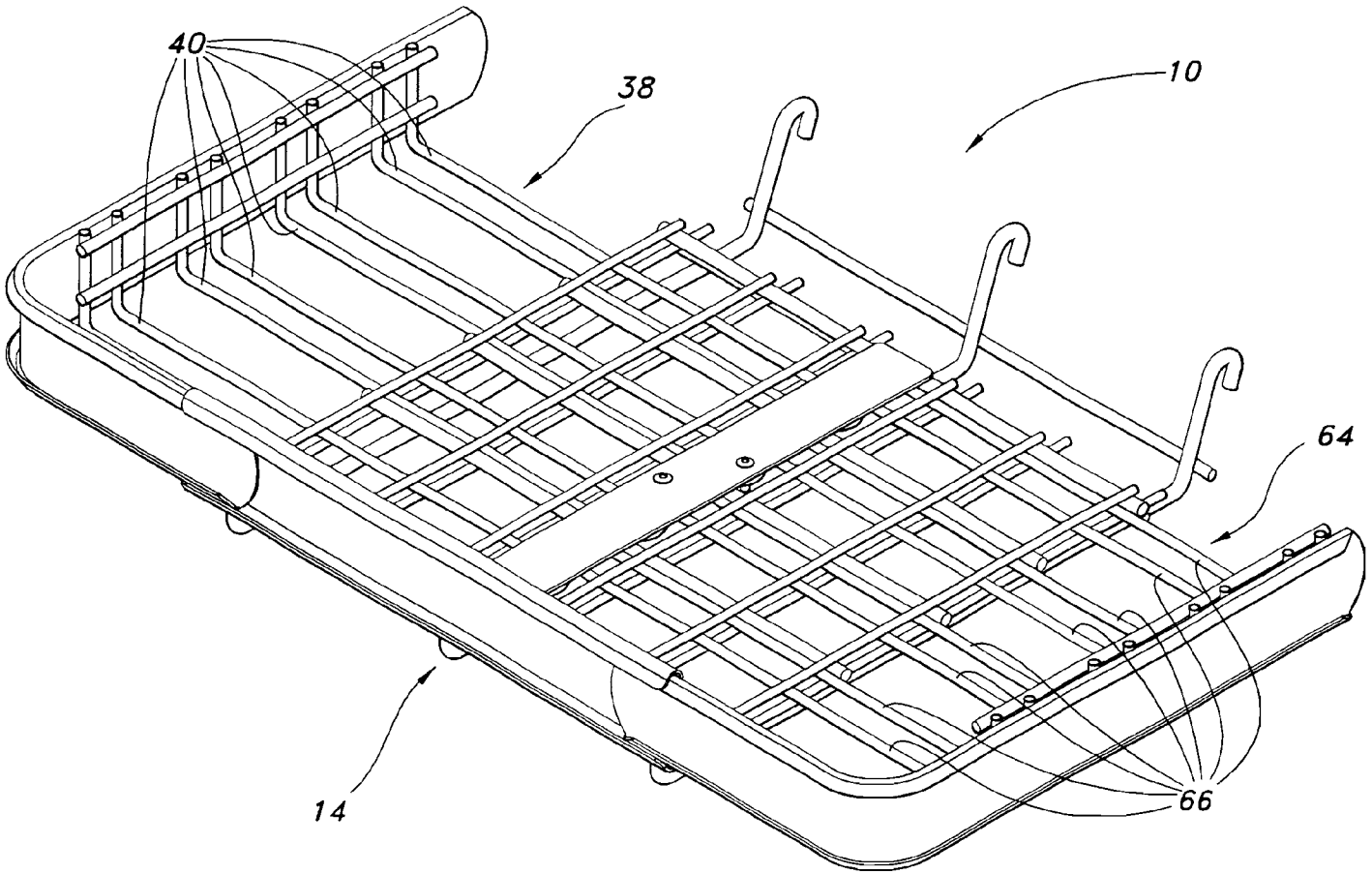
FIG. 7 shows a perspective view of the adjustable shelf assembly of FIG. 1 in an extended orientation.
Figure 8:
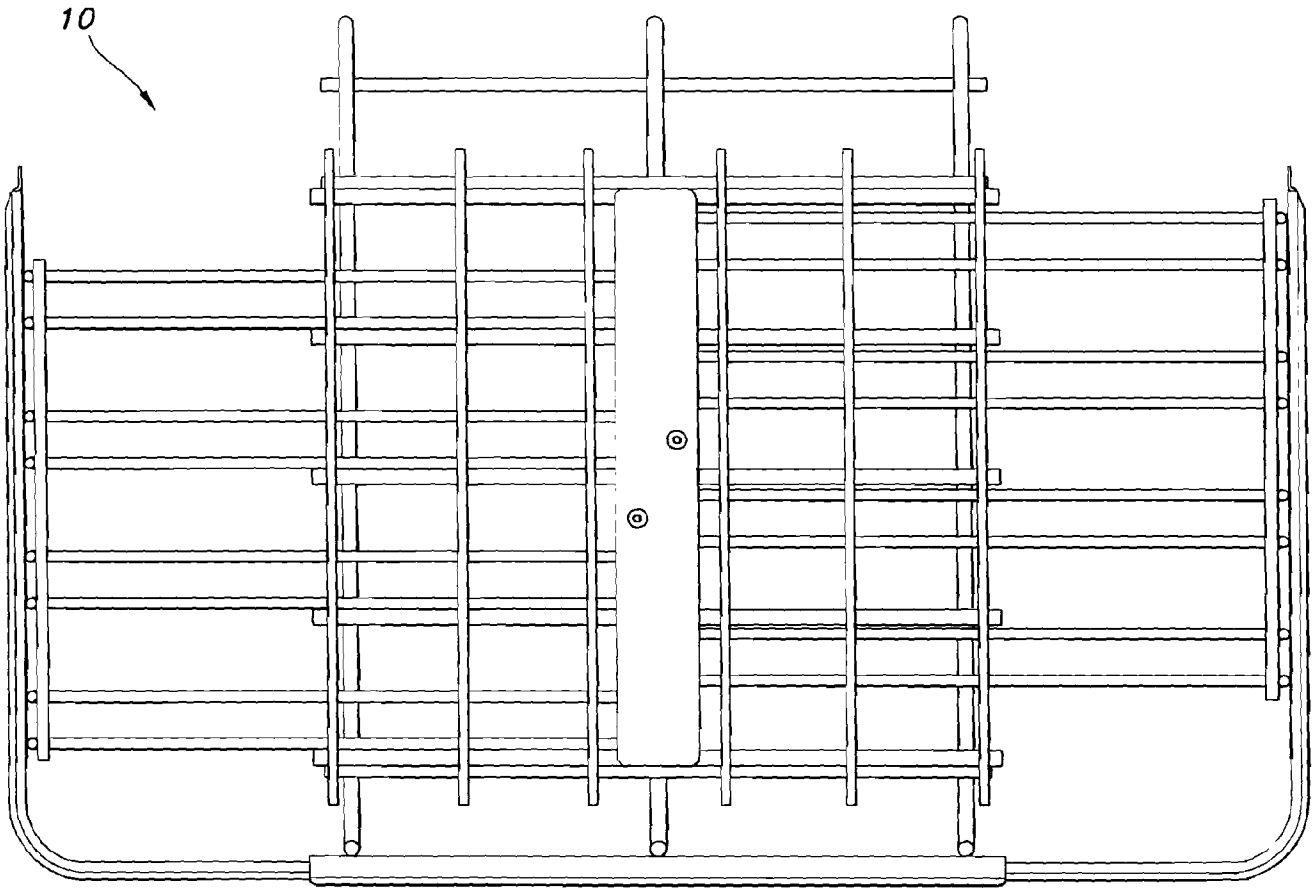
FIG. 8 shows a top view of the adjustable shelf assembly of FIG. 7.

In the embodiments shown in FIGS. 1-10, the width of the adjustable shelf assembly 10 may be adjusted by sliding the first extension shelf unit 38 and/or the second extension shelf unit 64 relative to the central shelf unit 14. Extending either the first or second extension shelf unit 38 or 64 relative to the central shelf unit 14 increases the width of the adjustable shelf assembly 10. Retracting either the first or second extension shelf unit 38 or 64 relative to the central shelf unit 14 decreases the width of the adjustable shelf assembly 10. FIGS. 1-6 and 9 show an adjustable shelf assembly 10 in a fully retracted orientation. FIGS. 7 and 8 show an adjustable shelf assembly 10 in a fully extended orientation.

Adjustable shelf assembly 10 may be created in any desired dimensions. In certain embodiments, adjustable shelf assembly 10 is fully adjustable between widths of 9 and 14 inches. Such a size is preferred for countertop product displays proximate to a point of sale or proximate to various dispensers including coffee or soda machines. However, adjustable shelf assembly 10 may have larger dimensions. Larger dimensioned shelves may be desired for large product displays or for accompanying large items such as coolers. Larger dimensioned shelves may also be desirable in other types of retail establishments.

In other embodiments of the present invention, an adjustable shelf assembly may include an extension shelf unit slidably oriented with respect to a central shelf unit such that the depth of the adjustable shelf assembly may be increased or decreased by extending or retracting the extension shelf unit with respect to the central shelf unit. Such extension shelf unit permitting depth adjustment may be formed and may function in a similar manner to extension shelf units 38 and 64 depicted in FIG. 1. In still other embodiments, an adjustable shelf assembly may include extension shelf units for adjusting width as well as extension shelf units for adjusting depth.

As shown in FIG. 1, when first and second extension shelf units 38 and 64 are in a retracted orientation, interlocking members 50 and 76 of the first and second extension shelf units 38 and 64 interlock with one another. Interlocking members 50 and 76 are formed from portions of the support surfaces of first and second extension shelf units 40 and 66. Interlocking members 50 and 76 may be formed from any suitable material into any suitable shape. As shown in FIG. 1, interlocking members 50 and 76 are formed into fingers from bent wire. The interlocking members 50 and 76 are staggered relative to each other such that portions of the first and second extension shelf units 38 and 64 may interlock with one another when in a retracted orientation. As shown in FIG. 1, extension and retraction of first and second extension shelf units 38 and 64 are guided by the sliding interaction of interlocking members 50 and 76. Additionally, extension and retraction may be guided by the sliding interaction of interlocking members 50 and 76 with guide rails 82.

Figure 3:
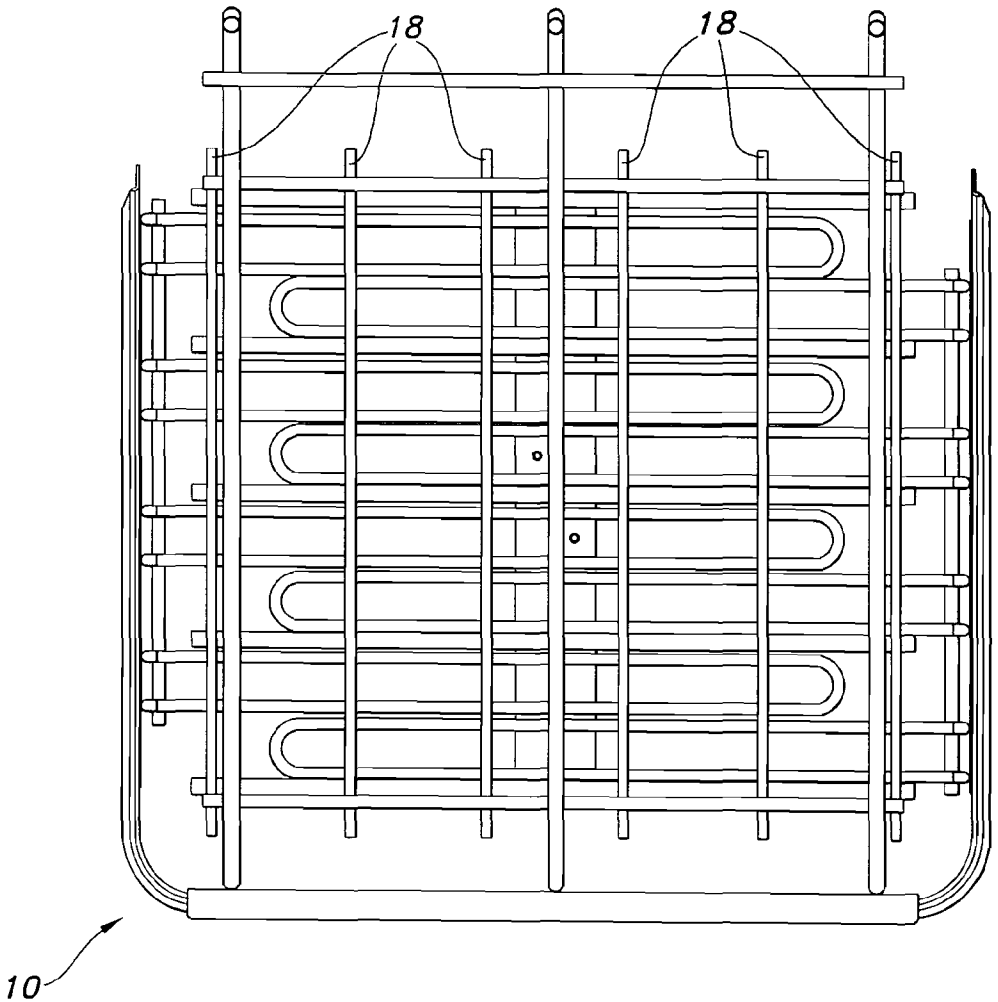
FIG. 3 shows a bottom view of the adjustable shelf assembly of FIG. 1.
Figure 4:
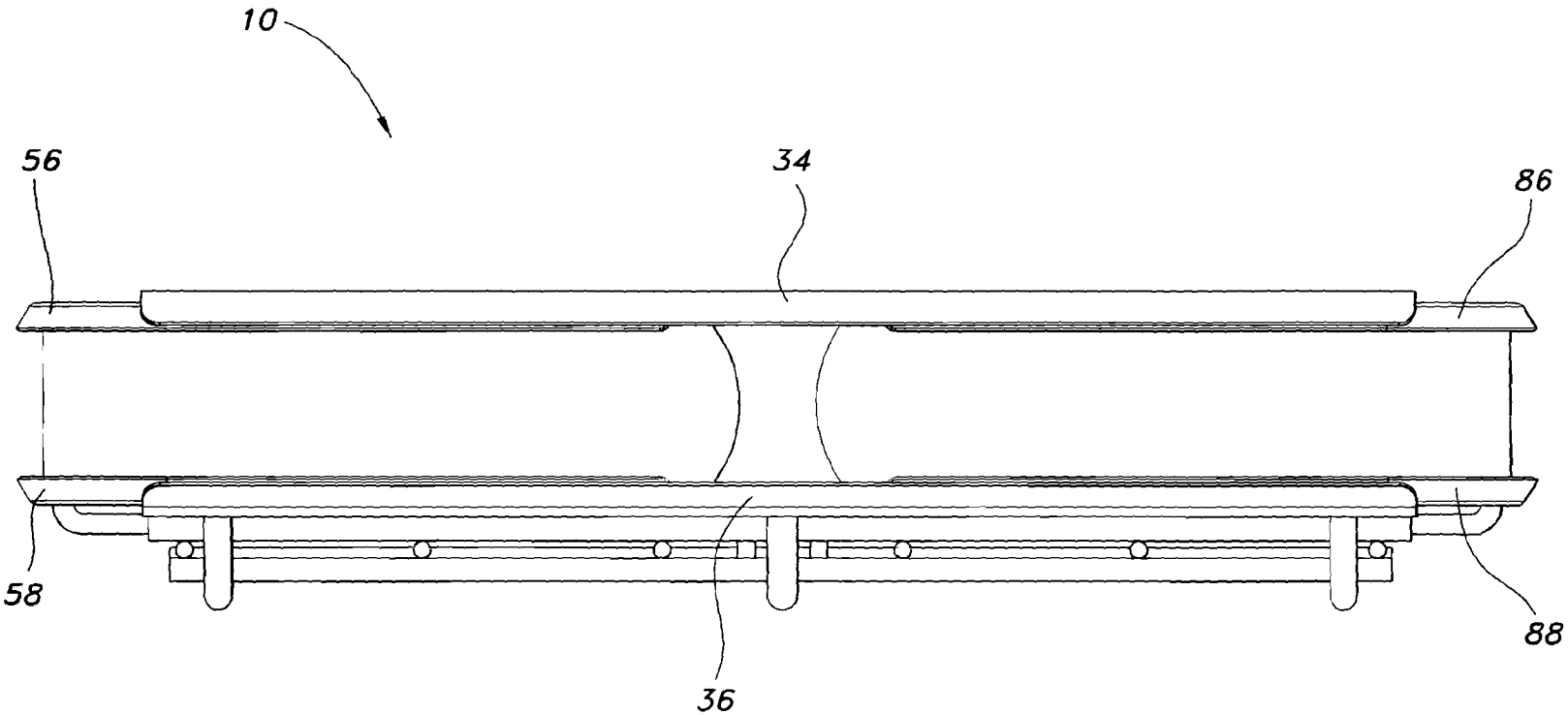
FIG. 4 shows a front view of the adjustable shelf assembly of FIG. 1.
Figure 5:
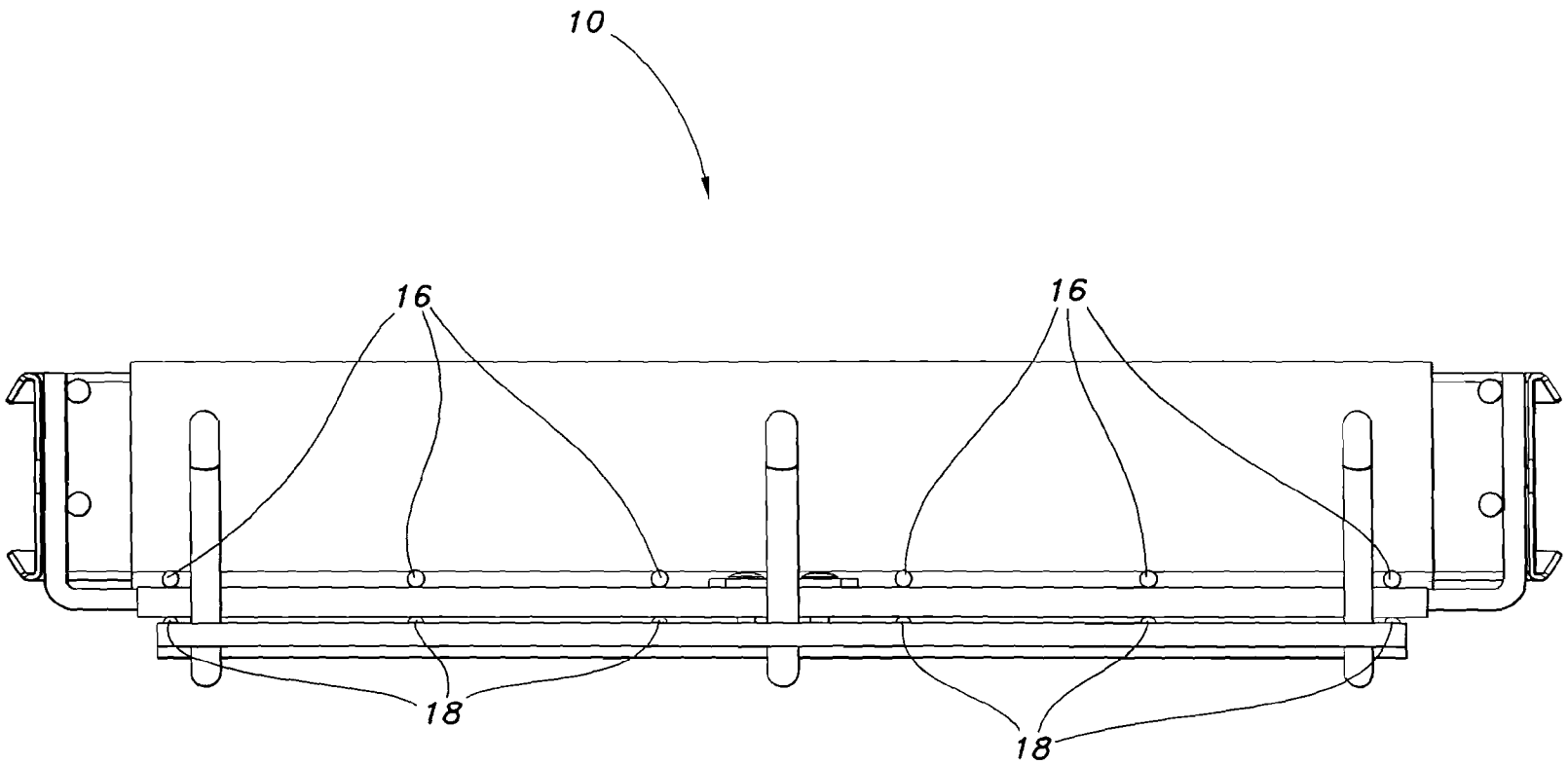
FIG. 5 shows a rear view of the adjustable shelf assembly of FIG. 1.
Figure 6:
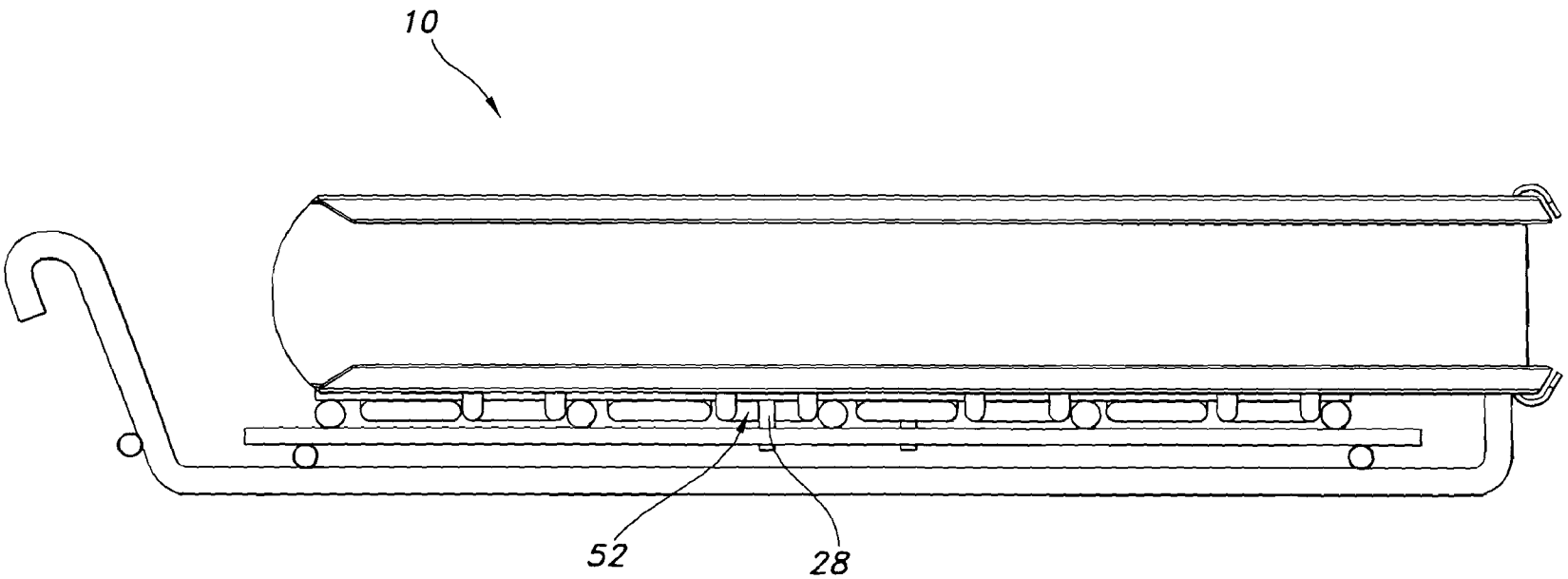
FIG. 6 shows a side view of the adjustable shelf assembly of FIG. 1.

As shown in FIG. 3, central shelf unit 14 may include stops 28 downwardly extending from a portion of the top surface 16. Stops 28 are oriented to interact with interior tip portions of first and second extension shelf units 52 and 78 when first and second extension shelf units 38 and 64 are fully extended. Interior tip portions of first and second extension shelf units 52 and 78 are located proximate to the proximate sides of first and second extension shelf units 90 and 92 respectively. Stops 28 may be formed from any suitable material into any suitable shape. As shown in FIG. 3, stops 28 may be metal rivets. In other embodiments, stops 28 are not necessary, rather other portions of an adjustable shelf assembly may prevent further extension once an extension shelf unit is fully extended.

Figure 10:
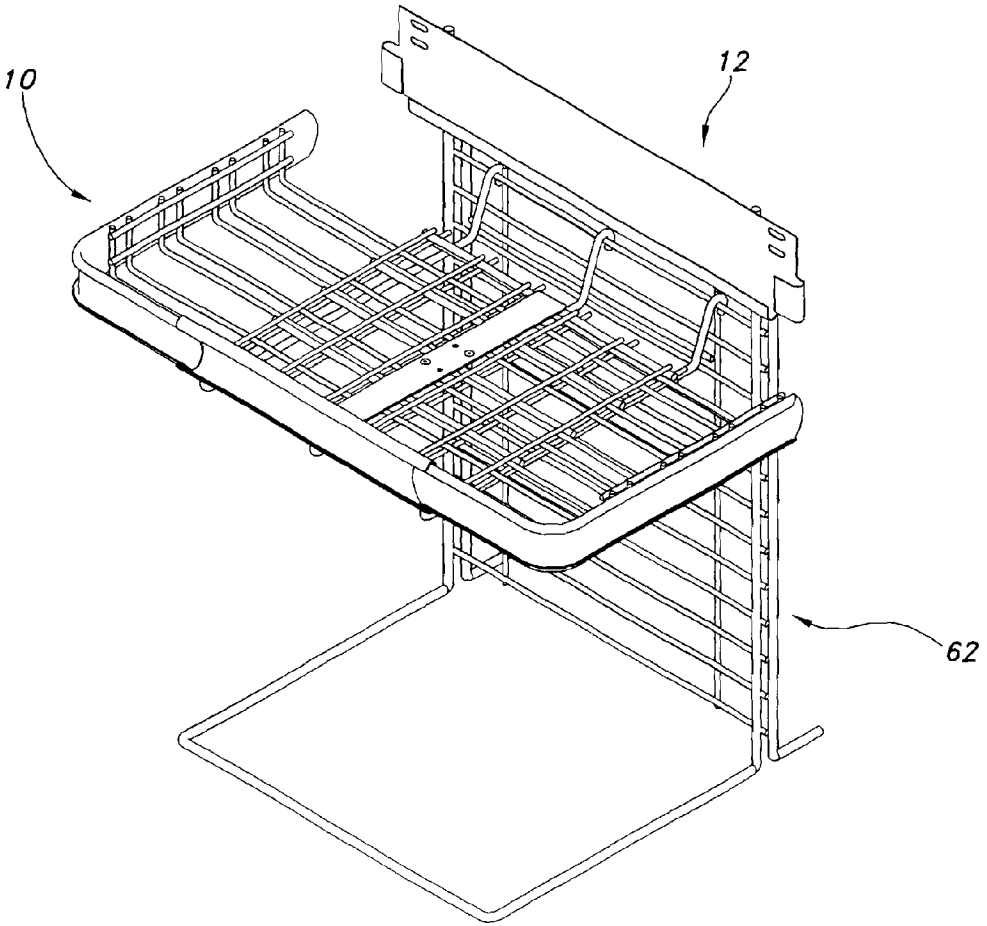
FIG. 10 shows a shelving assembly with an adjustable shelf according to certain embodiments of the present invention in perspective view.

As shown in FIG. 1, the central shelf unit includes attachment members 60. Attachment members 60 may be of any suitable shape and formed from any suitable material. In the embodiment shown in FIG. 1, attachment members 60 are hooks formed from bent wire extending from the central shelf unit rear edge 22. As shown in FIG. 10, attachment members 60 permit adjustable shelf assembly to be secured to a support structure 62. Support structure 62 may be any suitable structure capable of supporting adjustable shelf assembly 10, such as a wire rack, a power wing, a peg board, a wall mounted bracket or any other appropriate structure. As shown in FIG. 10, support structure 62 may be a rack formed from bent wire. Although only one adjustable shelf assembly 10 is depicted in FIG. 10, it should be readily understood that multiple adjustable shelf assemblies 10 may be secured to a single support structure 62.

Figure 9:
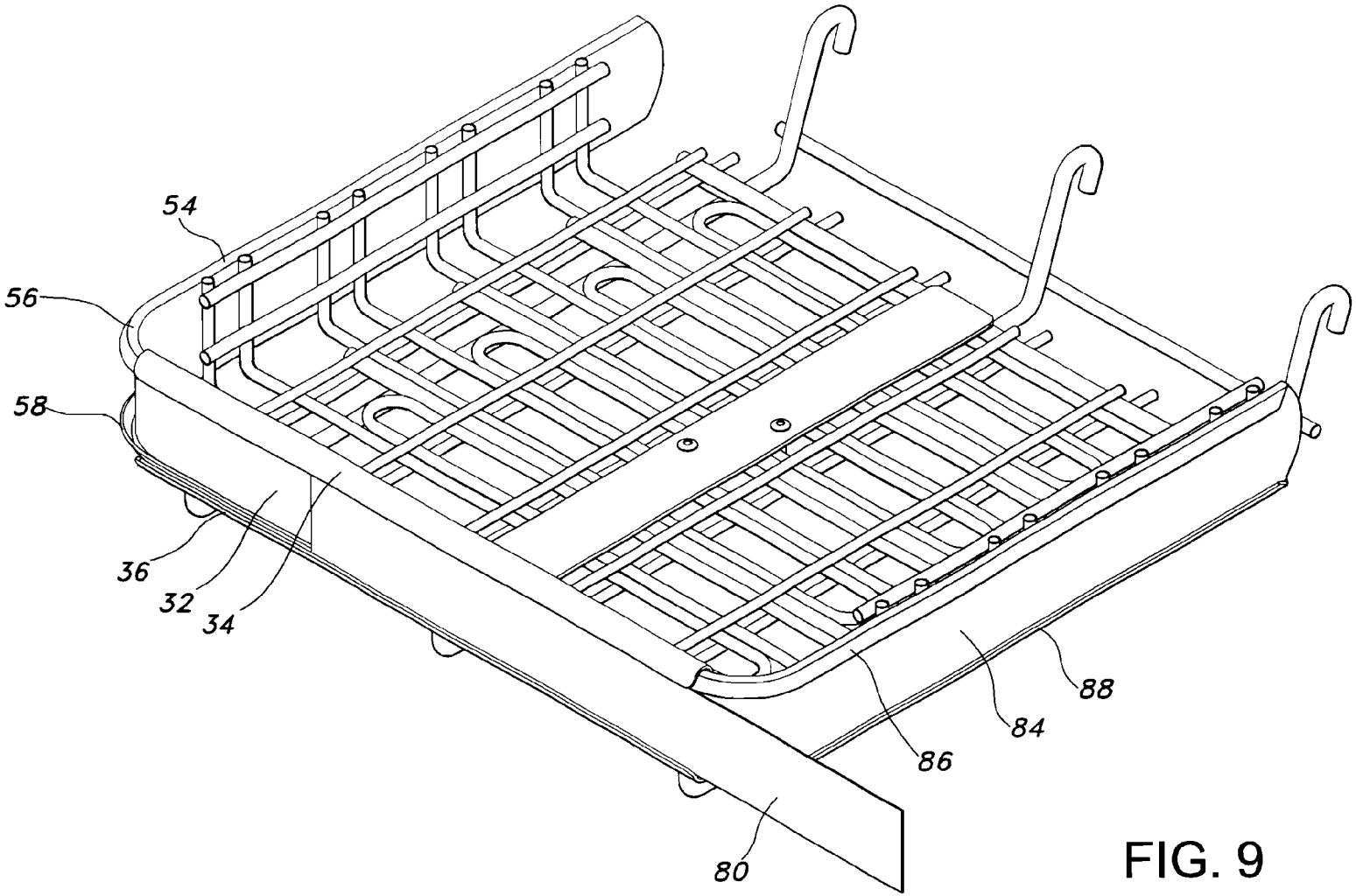
FIG. 9 shows an adjustable shelf assembly in a retracted orientation according to certain embodiments of the present invention in perspective view.

As shown in FIG. 9, the adjustable shelf assembly 10 may include structure for receiving a flexible member 80, such as a product identifier, price listing, advertisement or any other desired matter. As shown in FIG. 9, a front member 32 on central shelf unit 14 includes an upper lip 34 and a lower lip 36. Upper and lower lips 34 and 36 are formed into channels suitable for slidably receiving an appropriately sized flexible member 80. In the embodiment shown in FIG. 9, adjustable shelf assembly 10 also includes first and second side members 54 and 84 secured to first and second extension shelf units 38 and 64 respectively. FIG. 9 shows first and second side members 54 and 84, which are preferably L-shaped and secured to the front and distal side edges of first and second extension shelf units 42, 48, 68 and 74 respectively. First and second side members 54 and 84 are slidably coupled to front member 32 such that extension and retraction of first and second extension shelf units 38 and 64 is not substantially inhibited. First and second side members 54 and 84 include upper and lower lips 56, 58, 86 and 88 respectively such that the same, or different, flexible members 80 may be inserted into the channels formed by the lips 56, 58, 86 and 88.

Figure 11:
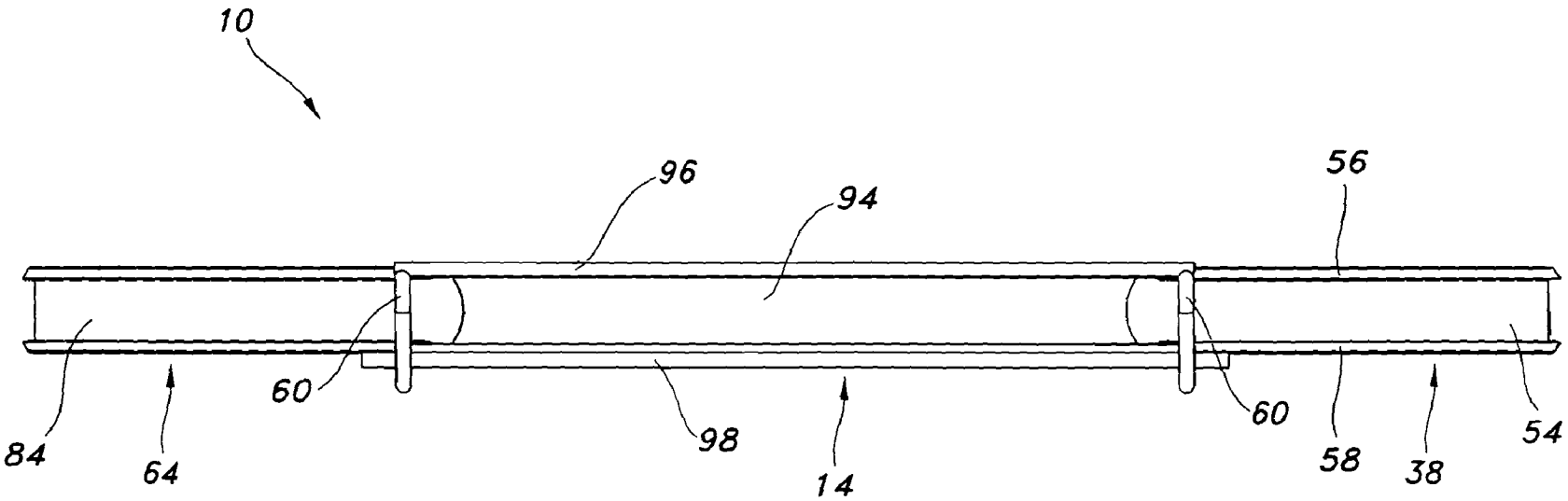
FIG. 11 shows a rear view of an adjustable shelf assembly in an extended orientation according to certain embodiments of the present invention.
Figure 12:
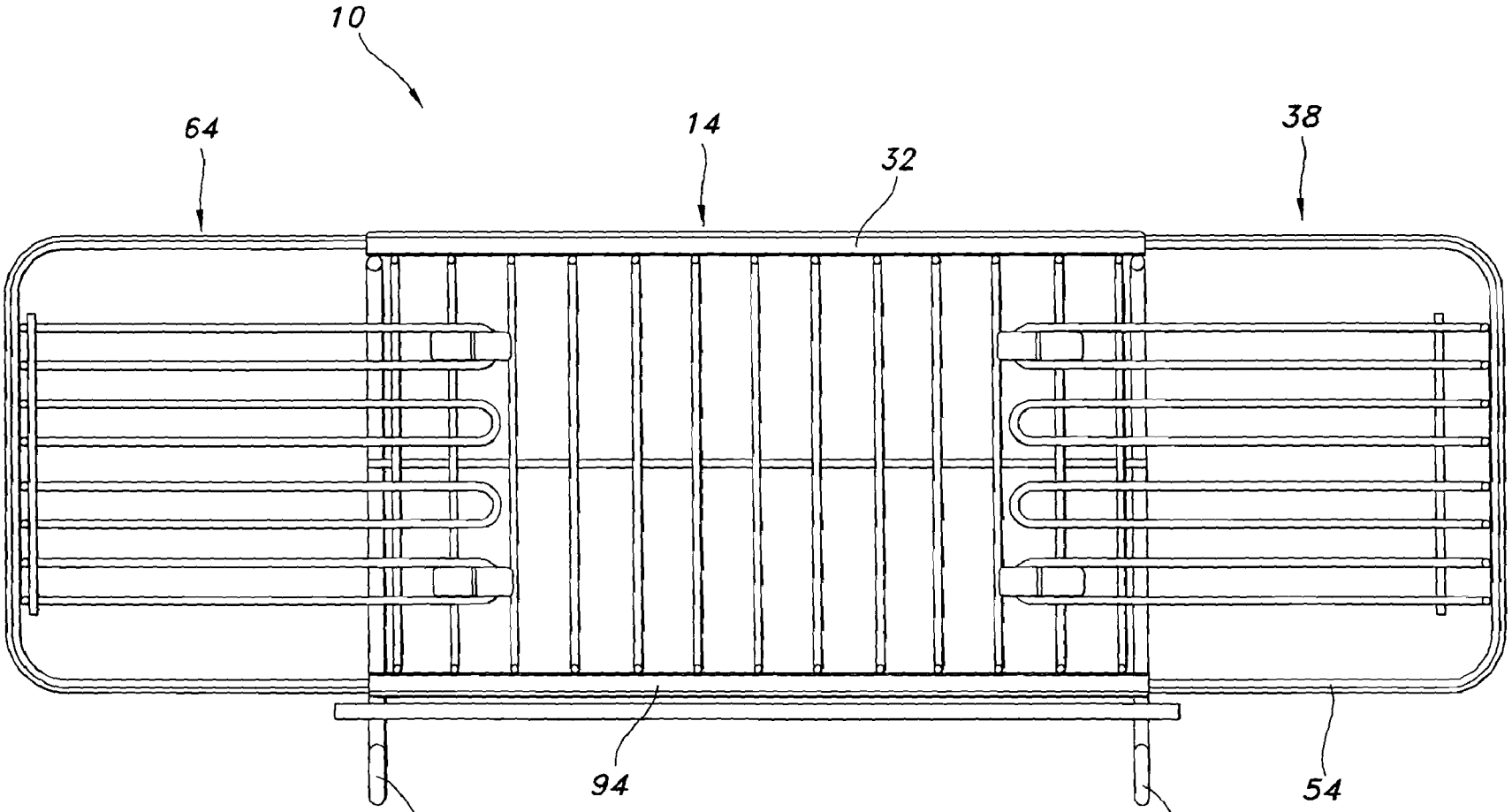
FIG. 12 shows a top view of the adjustable shelf assembly of FIG. 11.
Figure 13:
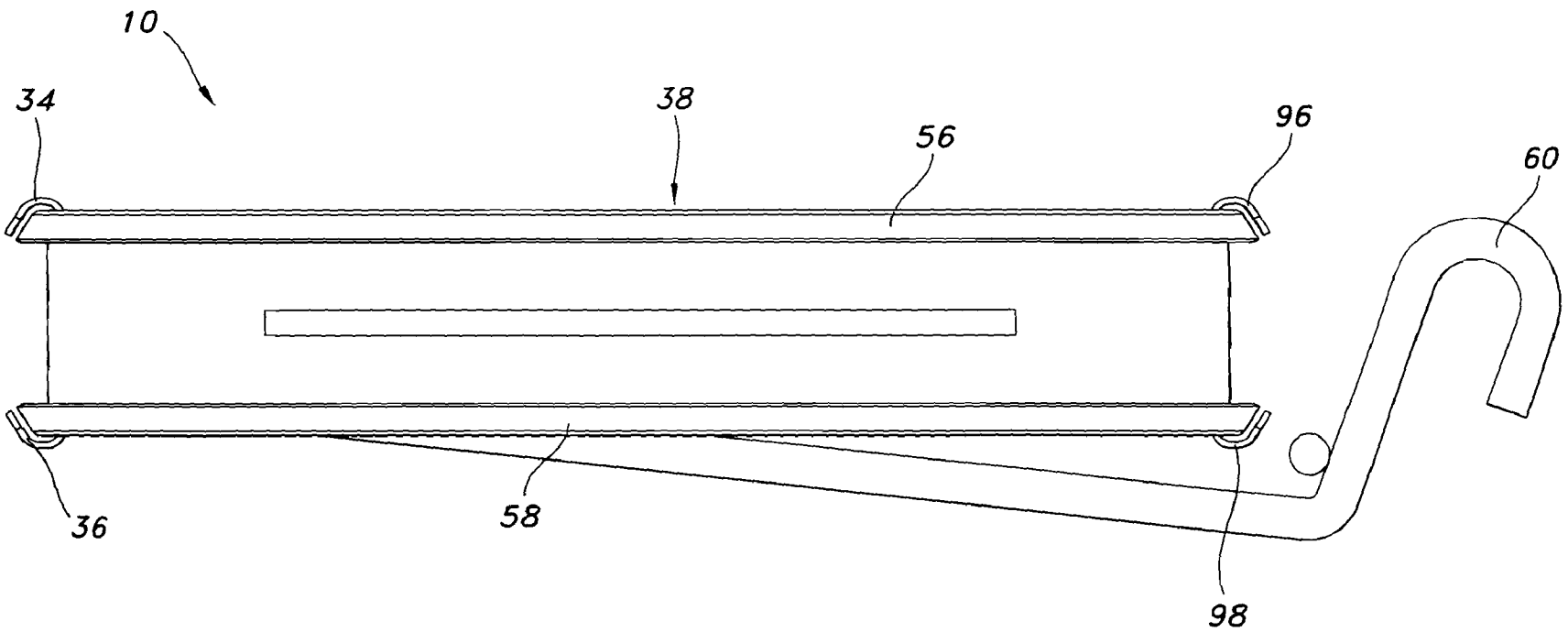
FIG. 13 shows a side view of the adjustable shelf assembly of FIG. 12.

As shown in FIGS. 11-13, the adjustable shelf assembly 10 may comprise a rear member 94 in addition to front member 32. Rear member 94 may be formed and shaped similarly to front member 32, and may interact with first and second side members 54 and 84 in a similar fashion as first and second side members 54 and 84 interact with front member 32. The rear member 94 may receive the same, or a different, flexible member as front member 32. The rear member 94 on central shelf unit 14 includes an upper lip 96 and a lower lip 98. The upper and lower lips 96 and 98 are formed into channels suitable for slidably receiving an appropriately sized flexible member 80. In some of the embodiments that include the rear member 94, the side members 54 and 84 are preferably C-shaped, rather than L-shaped. The first and second side members 54 and 84 are slidably coupled to rear member 32 such that extension and retraction of first and second extension shelf units 38 and 64 is not substantially inhibited.

Changes and modifications, additions and deletions may be made to the structures recited above and shown in the drawings without departing from the scope or spirit of the invention.

The invention clamed is:

1. An adjustable shelf assembly, comprising:

(a) a central shelf unit, (b) a first extension shelf unit, the first extension shelf unit slidably oriented with respect to the central shelf unit such that the width or depth of the adjustable shelving assembly may be increased by extending and decreased by retracting the first extension shelf unit with respect to the central shelf unit, the first extension shelf unit slidably oriented with respect to the central shelf unit such that retracted portions of the extension shelf unit are located underneath the top surface of the central shelf unit, the first extension shelf unit having a support surface, a front edge, a rear edge, a distal side and a proximate side, the distal side located distal to the central shelf unit relative to the proximate side; and (c) at least one attachment member secured to the adjustable shelf assembly such that when the attachment member is secured to a support structure, the first extension shelf unit may be extended or retracted with respect to the central shelf unit without repositioning the attachment member with respect to the support structure; and (d) a second extension shelf unit, the second extension shelf unit slidably oriented with respect to the central shelf unit such that the width of the adjustable shelving assembly may be increased by extending and decreased by retracting the second extension shelf unit with respect to the central shelf unit, the second extension shelf until slidably oriented with respect to the central shelf unit such that retracted portions of the second extension shelf unit are located underneath the top surface of the central shelf unit, the second extension shelf having a support surface, a front edge, a rear edge, a proximate side and a distal side, the distal side located distal to the central shelf unit relative to the proximate side; and (e) interlocking members formed from portions of the first and second extension shelf units, portions of the interlocking members of the first extension shelf unit interlocking with portions of the interlocking members of the second extension shelf unit when the first and second extension shelf units are retracted with respect to the central shelf unit.

2. The adjustable shelf assembly of claim 1, wherein the interlocking members are fingers formed from bent wire.

3. The adjustable shelf assembly of claim 1 wherein the central shelf unit does not move relative to the first and second extension shelf units during extension and retraction of the extension shelf units.

4. The adjustable shelf assembly of claim 1, further comprising:

(a) a front member extending from the front edge of the central shelf unit, the front member comprising an upper lip and a lower lip;

(b) a first side member extending from the front and distal side edges of the first extension shelf unit, the first side member having an upper lip and a lower lip; and (c) wherein portions of the front member and first side member slidably cooperate with respect to each other such that extension and retraction of the first extension shelf unit is not substantially hindered.

5. The adjustable shelf assembly of claim 4, wherein the upper and lower lips of the front member and first side members are formed into channels, permitting the insertion of a flexible member such that the flexible member is retained in between the upper and lower lips.

6. An adjustable shelf assembly, comprising:

(a) a central shelf unit;

(b) a first extension shelf unit;

(i) the first extension shelf unit slidably oriented with respect to the central shelf unit such that the width of depth of the adjustable shelving assembly may be increased by extending and decreased by retracting the first extension shelf unit with respect to the central shelf unit;

(ii) the first extension shelf unit slidably oriented with respect to the central shelf unit such that retracted portions of the extension shelf unit are located underneath the top surface of the central shelf unit; and (iii) the first extension shelf unit having a support surface, a front edge, a rear edge, a distal side and a proximate side, the distal side located distal to the central shelf unit relative to the proximate side;

(c) a second extension shelf unit;

(i) the second extension shelf unit slidably oriented with respect to the central shelf unit such that the width of the adjustable shelving assembly may be increased by extending and decreased by retracting the second extension shelf unit with respect to the central shelf unit;

(ii) the second extension shelf unit slidably oriented with respect to the central shelf unit such that retracted portions of the second extension shelf unit are located underneath the top surface of the central shelf unit; and (iii) the second extension shelf unit having a support surface, a front edge, a rear edge, a proximate side and a distal side, the distal side located distal to the central shelf unit relative to the proximate side;

(d) interlocking members formed from portions of the first and second extension shelf units, portions of the interlocking members of the first extension shelf unit interlocking with portions of the interlocking members of the second extension shelf unit when the first and second extension shelf units are retracted with respect to the central shelf unit;

(e) at least one attachment member secured to the adjustable shelf assembly such that when the attachment member is secured to a support structure, the first extension shelf unit may be extended or retracted with respect to the central shelf unit without repositioning the attachment member with respect to the support structure;

(f) a front member extending from the front edge of the central shelf unit, the front member comprising an upper lip and a lower lip; and (g) a first side member extending from the front and distal side edges of the first extension shelf unit, the first side member having an upper lip and a lower lip;

wherein portions of the front member and first side member slidably cooperate with respect to each other such that extension and retraction of the first extension shelf unit is not substantially hindered.

* * * * *